US005309179A

United States Patent [19]

Agbezuge et al.

[11] Patent Number: 5,309,179

[45] Date of Patent: May 3, 1994

[54] ENHANCEMENT OF INK FLOW DUCTS WITH HIGH SURFACE ENERGY MATERIAL INCLUSIONS

[75] Inventors: Lawrence K. Agbezuge, Penfield; Thomas N. Taylor, Rochester; John C. Ackerman, Webster, all of N.Y.

[73] Assignee: Xerox Corporation, Stamford, Conn.

[21] Appl. No.: 931,798

[22] Filed: Aug. 18, 1992

[51] Int. Cl.[5] ..... B41J 2/19

[52] U.S. Cl. ..... 346/140 R; 138/39

[58] Field of Search ..... 346/140; 138/39, 37

[56] References Cited

U.S. PATENT DOCUMENTS

| | | | |
|---|---|---|---|
| 1,917,941 | 7/1933 | Hehr | 138/39 |
| 2,020,194 | 11/1935 | Kuhlmann | 138/37 |
| 2,842,421 | 7/1958 | Dreyfus | 346/140 X |
| 4,017,870 | 4/1977 | Hubbard | 346/140 A |
| 4,149,172 | 4/1979 | Heinzl | 346/140 |
| 4,490,731 | 12/1984 | Vaught | 346/140 |

*Primary Examiner*—Joseph W. Hartary
*Attorney, Agent, or Firm*—Oliff & Berridge

[57] ABSTRACT

An enhanced duct apparatus provides enhanced re-establishment of ink fluid flow between an ink reservoir and printheads when, for example, ink supply tubing located therebetween is filled with slugs of ink which prevent the flow from being established. The apparatus requires minimal head pressure, thus reducing reservoir depth, by including a high surface energy material within the tubing. Preferably, the material is in the form of a spring which may be of stainless steel. This inclusion of a high surface energy material is more readily wetted by the ink and allows substantially instantaneous overcoming of impedance, including adhesive, surface tension, and wetting forces, upon initiating opening of fluid flow from the reservoir through the duct.

9 Claims, 3 Drawing Sheets

PRIOR ART

PRIOR ART

ENHANCEMENT OF INK FLOW DUCTS WITH HIGH SURFACE ENERGY MATERIAL INCLUSIONS

BACKGROUND OF THE INVENTION

1. Field of the Invention

The present invention relates to enhancement of fluid flow through a duct by the inclusion of a high surface energy material, and more specifically to enhancement of ink flow through tubing of thermal ink jet printing devices.

2. Description of Related Art

In thermal ink jet printing devices, it is necessary to be able to turn ink flow on and off between an ink supply reservoir and a printhead. In a typical ink supply system, when the ink flow shuts off, slugs of ink, separated by air pockets, form in the duct or supply tube communicating the ink between the reservoir and the printhead. These slugs of ink prevent ink flow from being re-established. This is due to the forces of wetting and surface tension acting on the inner walls of the duct and the slugs.

A possible solution to the problem would be to pressurize the ink reservoir. This however requires extra cost and complexity.

The force of adhesion, i.e., wetting of the tube walls, could also be reduced by coating the walls of the tube with a low surface energy material, such as RAIN-X, however such a solution will not be perfect and will not produce much benefit because the wetting forces are small compared with surface tension forces.

Another option would be to make the walls of the tube as smooth as possible in order to minimize the forces of wetting. This option is time consuming, costly, and still does not substantially reduce forces.

There is a need for a simple, low cost device which enhances the re-establishment of fluid flow in the duct.

OBJECTS AND SUMMARY OF THE INVENTION

It is an object of the present invention to provide a simple, low cost addition to a duct which communicates fluid between a reservoir and an outlet, the addition being capable of enhancing re-establishment of fluid flow, easily overcoming surface tension and wetting forces present in the duct caused by slugs of fluid trapped in the duct and properties of the duct.

It is another object of the present invention to introduce a high surface energy material, such as in the form of a spring, into a duct formed of a low surface energy material. The high surface energy material is more readily wetted than the duct to quickly overcome the forces acting on the slug and provide re-establishment of fluid flow through the duct shortly after opening of the reservoir.

The present invention achieves the above objects and re-establishes fluid flow. The present invention can be used in any application where slugs of fluid remain in a duct between a supply and an outlet. This is usually the case when the fluid has a high viscosity, such as an oil or ink, and the duct is formed of a low surface energy material. In an exemplary application relating to thermal ink jet printing devices, the present invention restores or re-establishes ink fluid flow between an ink reservoir and printheads when ink supply tubing located therebetween is commonly filled with slugs of ink which prevent the flow from being re-established (See FIG. 1). Experience has shown that the tubing being used, a polyethylene tubing, does not permit flow to begin after ink slugs have formed in the duct of tubing having a low surface energy. To initiate ink flow requires that the pressure head H across the slug overcomes all impedance to ink flow. This impedance includes surface tension forces and wetting forces. The present invention provides a material of a high surface energy, preferably in the shape of a spring, which is inserted and contained within the tube. This inclusion of a high surface energy material is more readily wetted by the ink and allows substantially instantaneous overcoming of the impedance upon initiating opening of fluid through the duct.

These and other objects will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
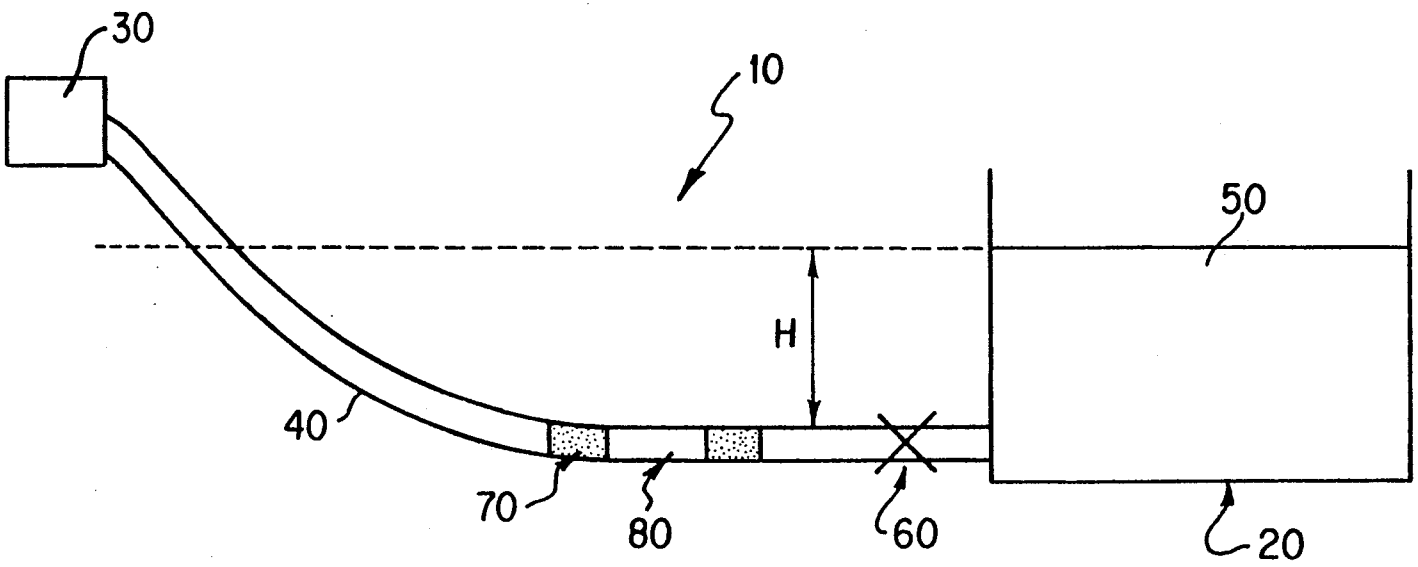
FIG. 1 shows a representation of a typical ink supply reservoir and tubing which communicates ink between the reservoir and a printhead.

The present invention as exemplified in a preferred embodiment provides restoration of ink fluid flow in an ink printing system 10. The ink printing system 10 comprises an ink supply reservoir 20, a printhead 30, and tubing 40 providing fluid communication between the reservoir 20 and the printhead 30. Ink 50 contained in the reservoir 20 is supplied to the printhead 30 through the tubing 40. Usually, a valve 60 is provided near the reservoir 20 to shut off the supply of ink 50 to the printhead 30. Upon shutting off of the supply by closing valve 60, slugs of ink 70 remain in the tubing 40, the slugs of ink being separated by air pockets 80.

Figure 2A:
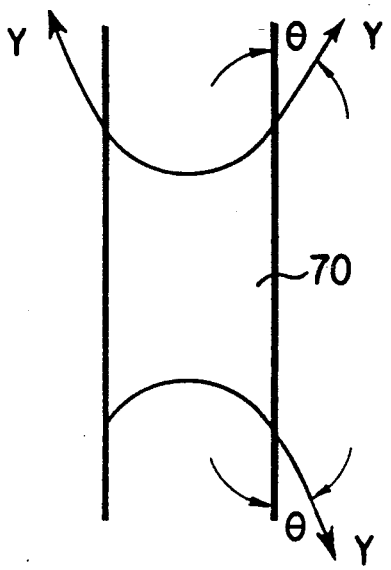
FIG. 2A PRIOR ART
FIG. 2A shows a cross-section of the tubing containing a slug of ink and representation of forces acting therein before the ink slug begins to move.

Consider a slug of ink 70 stuck in the tube 40 as shown in FIG. 2A where the ink flow direction is shown as A. To initiate ink flow requires that pressure head H across the slug should overcome all impedance to ink flow, that is, the pressure head H (FIG. 1) must overcome surface tension forces and wetting forces.

Figure 2B:
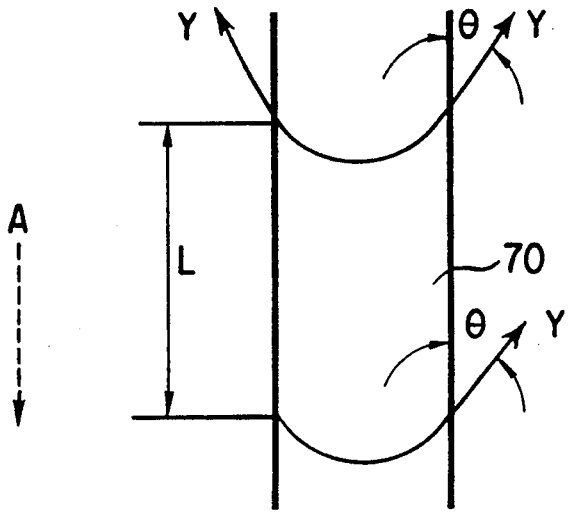
FIG. 2B PRIOR ART
FIG. 2B shows a cross-section of the tubing containing a slug of ink and representation of forces acting therein after the ink begins to move.

When the slug of ink begins to flow, in the direction of A, surface tension forces are doubled (FIG. 2B), and force balance requires that $$p_{cr}\pi R^2 \geqq 4\pi R y \cos\theta + F_w L$$

where $p_{cr}$=minimum (critical) pressure required,

R=radius of tube, y=surface tension of ink, $\theta$=contact angle between ink and tube wall, $F_w$=wetting (adhesive) force per unit length between ink and tube wall, L=length of ink slug.

Figure 3:
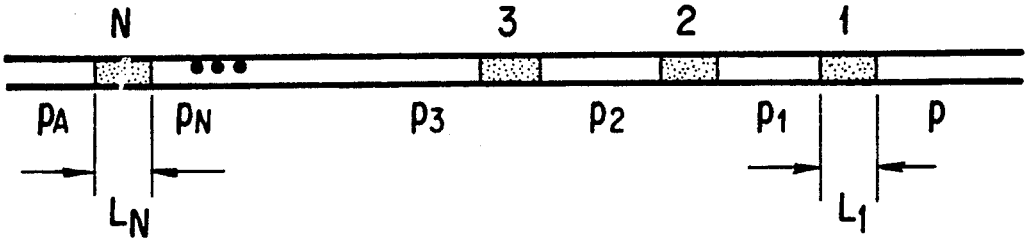
FIG. 3 shows a cross-section of a substantial distance of the tubing of FIG. 1, showing several ink slugs separated by air pockets and pressures contained therein.

Depending on how long the tube is, there will probably be several ink slugs in the tube, as shown in FIG. 3. The pressure head required to drive out the slugs increases in proportion to the number of slugs. This can be explained as follows: Let pressure drop across slug number 1=p. $p_1$, across slug number 2=$p_1-p_2$, and so on. As shown, p=supply pressure and $p_A$=atmospheric pressure.

For N ink pockets, $$p - p_1 = F_{y1} + F_w L_1$$

$$p_1 - p_2 = F_{y2} + F_w L_2$$

$$\ldots$$

$$p_{j-1} - p_j = F_{yj} + F_w L_j$$

$$\ldots$$

$$p_{N-1} - p_A = F_{yN} + F_w L_N,$$

where $F_{yj}$ and $F_w$ denote respectively, equivalent surface tension force on slug number j and wetting pressure force per unit length (j=1,2 . . . N).

Summing the forces yields $$P - P_A = \sum_{j}^{N} [F_{yj} + F_w L_j]$$

The forces of wetting, friction, and adhesion between the ink and the walls of the tube can be expressed as $$F_w=(64/Re)[\rho V^2/2g]$$

where

Re=Reynolds Number,

V=flow velocity, $\rho$=mass density of ink.

EXAMPLE 1

An ink supply tube of polyethylene having an inner diameter of 3/32" has a surface energy between 20 and 40 dyne-cm. The surface tension of the ink utilized, y, was 72.8 dyne/cm which equals $72.8\times10^{-3}$ N/m. Water was utilized in the reservoir during experimentation because it closely approximates the relevant properties of the ink. 1" of water pressure equals 249.1 N/m$^2$. In the case of complete wetting, with $\theta=0$ and $Fw<<Y$, $P_{cr}\simeq(4y)/R$.

For the case of only one ink slug in the tube, the relationship between the required pressure head H and tube diameter D is $$D = 2R = \frac{[8(72.8 \times 10^{-3})(10^3)]}{(249.1)} = \frac{2.34}{H} \text{ mm}$$

where H equals inches of water.

An experiment was conducted in which ten ink slugs 70 were provided in the tube 40, each separated by air pockets 80. The height H of the water was increased until flow was obtained through the tube. Flow was obtained at H=10". Analytically solving for this particular case with D=3/32"=2.38 mm, the required H for flow is $$H = \frac{(10)(2.34)}{2.38} = 9.8''$$

This substantially equals the experimental value and confirms the results obtained experimentally.

EXAMPLE 2

In this example, the tube 40 contained between 8–10 ink slugs 70. The height of water in the reservoir was H=2".

Flow from the reservoir 20 to the tube 40 was initiated by opening valve 60. No through flow was obtained. This was to be expected since Example 1 required an H of 10" for substantially the same number of slugs contained in the tube.

Figure 4:
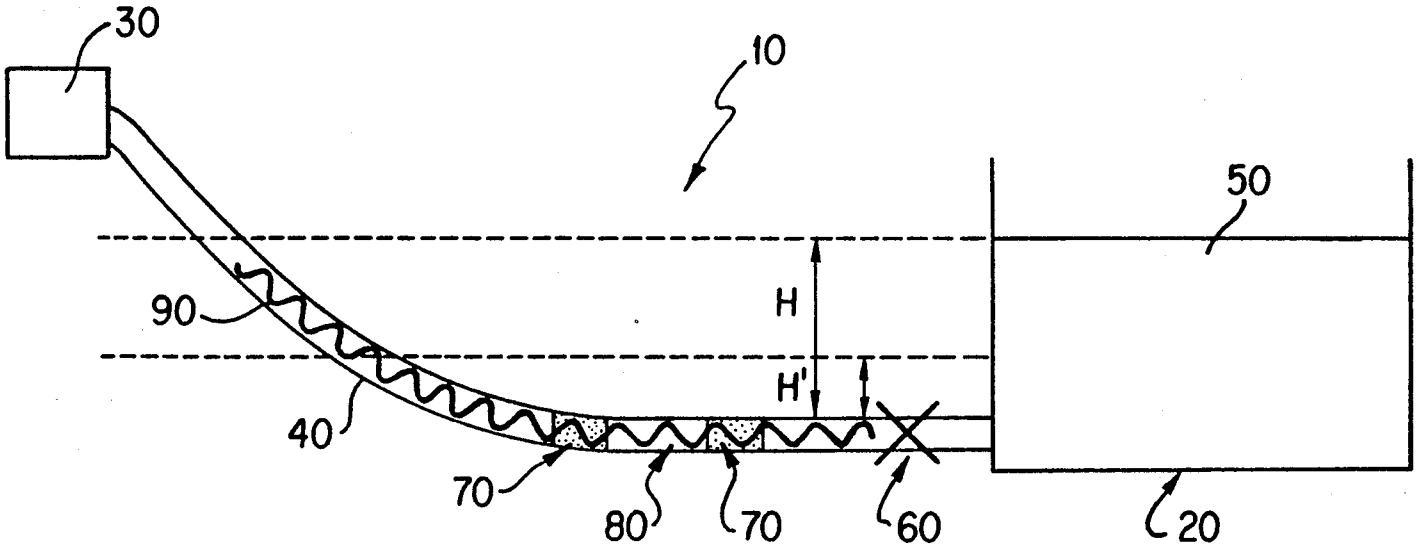
FIG. 4 shows a representation of a typical ink supply reservoir and tubing which communicates ink between the reservoir and a printhead which includes a novel high surface energy material within the tubing to enhance fluid flow through the tubing according to an embodiment of the present invention.

The flow was shut off by closing valve 60 and a stainless steel spring 90 having a 0.018" wire diameter, a 0.109" spring diameter, and a pitch of approximately six turns per inch was inserted into the tubing 40 as shown in FIG. 4.

Again, the valve 60 was opened. This time flow through the tubing 40 was obtained immediately. Aqueous ink formulations will have additives which lower the surface tension, that is, the surface tension will never exceed 72.8 dynes/cm. This invention will work even better with aqueous ink formulations, since the forces to be overcome will be less.

This clearly demonstrates that the use of a high surface energy material within the tube provides enhanced flow of the ink and solves a current ink flow problem.

Many alternate embodiments are envisioned. The high surface energy material does not need to be in the shape of a spring, but can take many other forms.

For example, the material could be an ordinary concentric inner tubing of high surface energy material. This would be a preferred geometry, if flow velocities are high enough to cause vortex shedding.

Other geometries, such as airfoil shapes, which provide laminar flow and prevent flow separation should be apparent to those skilled in the art of fluid flow phenomena.

The spring 90 can be made from many alternate materials. The main criteria is that the spring should be of a material having a sufficiently higher surface energy to overcome the deficiencies of the tube or duct, i.e., has greater surface tension and wetting forces between the fluid and the spring than between the fluid and the wall of the tube.

In addition to being a high surface energy material, the material of the spring should be able to resist corrosion due to ingredients in the ink formulation. Stainless steel satisfies this requirement fairly well, but other materials could satisfy the same requirement.

Although described with specific dimensions, the spring generally can be of any size capable of insertion within the tubing 40 and preferably has a pitch substantially equal to or smaller than the average size of a slug 70 in the tubing 40. Spring wire diameter is not as critical of a dimension as pitch. However, spring wire diameter can also be influenced by other criteria, such as desired flexibility of the tubing after insertion of the spring or weight requirements.

Optimum dimensions should be determined by experimentation. One criterion for selecting optimum spring dimensions is that flow separation and vortex shedding should be minimized, and another criterion is that the pitch of the spring makes it possible for air pockets to be broken up.

As in the present example, the spring is a low cost addition to an existing system which alleviates present deficiencies. The present invention has the advantage of not requiring replacement of existing ducts with a duct of higher cost, the present invention further resulting in a system with pressure head H which is low enough that it does not require a pump or a pressuring device. This allows for a smaller reservoir (reduced depth) or provides more reliable service even when the reservoir is low on fluid.

The invention has been described with reference to the preferred embodiments thereof, which are illustrative and not limiting. Various changes may be made without departing from the spirit and scope of the invention as defined in the appended claims.

What is claimed is:

1. An enhanced flow duct apparatus for communicating a liquid between a reservoir source and an outlet, a flow of liquid through the duct apparatus being cycled between on and off states, said off state stopping flow of said liquid and enabling formation of slugs of liquid having a longitudinal length, said slugs being trapped in the duct apparatus and separated by air pockets resulting in increased impedance to flow, the duct apparatus enhancing reestablishment of liquid flow in a subsequent on state including reduction of necessary pressure head at said reservoir source, the apparatus comprising:

a valve for cycling the flow of liquid between said on and off states;

a small diameter tube of a low surface energy material for communicating said liquid between said source and said outlet, said tube having an inner tube wall; and a member of a high surface energy material in the form of a spring located adjacent said inner wall and extending within said tube substantially from said source to said outlet, said member having greater surface tension and wetting forces between said liquid and said member than surface tension and wetting forces between said liquid and said inner wall to overcome the impedance of the slugs, said spring having a pitch at most equal to an average longitudinal length of said slugs.

2. The duct apparatus of claim 1, wherein said member is made of stainless steel.

3. The duct apparatus of claim 1, wherein said tube is a polyethylene tube.

4. The duct apparatus of claim 1, wherein said liquid is ink.

5. The duct apparatus of claim 4, wherein said source is an ink jet reservoir and said outlet leads to an ink jet printhead.

6. A duct for communicating a liquid between a reservoir source and an outlet, the duct being capable of enhanced establishment of flow when air pockets are present trapping slugs of liquid having determinable longitudinal lengths in the duct, comprising:

a tube of a predefined diameter having an inner wall of a low surface energy material for communicating said liquid therethrough from said source to said outlet; and a member of a high surface energy material in the shape of a spring having a defined pitch selected to be substantially no more than an average length of said slugs of liquid trapped between air pockets within said tube and being of a relatively small diameter compared to the diameter of said tube, said member being located adjacent said inner wall and extending through a substantial length of said tube, said member having greater surface tension and wetting forces between the liquid and the member than surface tension and wetting forces between the liquid and the inner wall to overcome increased impedance caused by the slugs.

7. The duct apparatus of claim 6, wherein said liquid is ink.

8. The duct apparatus of claim 7, wherein said source is an ink jet reservoir and said outlet leads to an ink jet printhead.

9. The duct apparatus of claim 6, wherein said spring is made of stainless steel.

* * * * *